US005273104A

United States Patent [19]

Renaud et al.

[11] Patent Number: 5,273,104

[45] Date of Patent: Dec. 28, 1993

[54] PROCESS FOR MAKING CORES USED IN INVESTMENT CASTING

[75] Inventors: Edward P. Renaud, Colchester; Edward C. Wingfield, Glastonbury; Wallace W. Bowley, Eastford, all of Conn.

[73] Assignee: United Technologies Corporation, Hartford, Conn.

[21] Appl. No.: 763,833

[22] Filed: Sep. 20, 1991

[51] Int. Cl.[5] ..... B22C 1/02

[52] U.S. Cl. ..... 164/529; 164/132; 164/369; 164/519; 164/361

[58] Field of Search ..... 164/132, 529, 361, 369, 164/519

[56] References Cited

U.S. PATENT DOCUMENTS

| | | | |
|---|---|---|---|
| 4,097,291 | 6/1978 | Huseby et al. | 164/132 |
| 4,097,292 | 6/1978 | Huseby et al. | 164/132 |
| 4,164,424 | 8/1979 | Klug et al. | 164/132 |

*Primary Examiner*—Kuang Y. Lin
*Attorney, Agent, or Firm*—James M. Rashid

[57] ABSTRACT

Casting cores particularly useful in the investment casting industry are described. The cores are characterized by the presence of hollow ceramic particles, which facilitate the removal of the core from the casting they are used to form. In a preferred embodiment of the invention, the core is characterized by solid and hollow ceramic particles sintered to each other to form a core matrix, and such particles have the same composition. In an even further preferred embodiment, high temperature stable fibers are distributed uniformly throughout the matrix.

8 Claims, 3 Drawing Sheets

PROCESS FOR MAKING CORES USED IN INVESTMENT CASTING

TECHNICAL FIELD

This invention relates to ceramic cores used in the investment casting of metals, and more particularly, to processes for making ceramic cores which can be removed easily from metal parts produced by investment casting.

BACKGROUND ART

Investment casting processes are extensively used in the production of nickel and cobalt base superalloy parts for gas turbine engines and other machines. In investment casting processes, a ceramic shell mold is formed around a wax pattern, with one or more ceramic cores precisely positioned within the pattern. After the mold-core composite is formed, the wax is removed from the composite by a firing operation. The core (or cores), in conjunction with the mold, define a cavity when the firing operation is complete. Molten metal is poured into and solidified in the cavity, and the cores are then removed from the metal casting by immersing the casting in an alkali leaching solution.

U.S. Pat. No. 4,836,268 to DeVendra describes porous casting cores which are said to be easier to leach from a metal casting than are dense cores. The DeVendra core has a closed cellular construction formed by a plurality of pores.

Some castings have very intricate internal passages produced by cores. In some part designs, these passages are configured such that the wall thickness between adjacent passages is as little as about 250 microns (10 mils). As is appreciated by those skilled in the art, the ability to produce such configurations requires a core which has excellent stability and strength, including the ability to withstand distortion during the firing and subsequent casting process.

In an effort to produce cores having the properties necessary to meet these needs, the casting industry has expended considerable effort to develop improved core compositions. One such composition is described in commonly assigned U.S. Pat. No. 4,989,664 to H. A. Roth. The Roth core composition includes a mixture of coarse and fine ceramic particles and high temperature stable fibers, the fibers present in an amount sufficient to preclude cracking and distortion of the core during the core firing process as well as during the metal casting process.

The leaching process for removing cores from metal castings is an important aspect of the overall process for making metal parts. If the core is not completely removed before the part, the residue which remains inside the casting can interfere with the proper performance of the part in service, which sometimes leads to premature failure of the part. To preclude such failures, castings are carefully inspected after leaching to make sure the core is completely removed. While the DeVendra core is said to have improved leachability characteristics as compared to fully dense cores, it is likely to have poor strength and stability owing to the abundance of pores in the core. It will therefore not likely be useful in making cores having a complex geometry. Accordingly, what is needed is a casting core having an optimum balance of strength and leachability.

Disclosure of Invention

According to this invention, a method for making an investment casting core comprises the steps of mixing solid ceramic particles to form a core mixture, molding the mixture to form a core shape, and firing the core shape to sinter the particles and make a core, wherein the improvement comprises substituting hollow ceramic particles for a portion of the solid ceramic particles.

In a preferred embodiment of this invention, the composition of the hollow particles in the core is the same as the composition of the solid particles that are replaced. The hollow particles have a wall thickness sufficient to enable the hollow particles to sinter to the solid particles in the core mixture and to themselves without excessive breaking, cracking or distortion.

In an even more preferred embodiment of the invention, high temperature stable fibers are uniformly distributed throughout the matrix of solid and hollow ceramic particles.

Cores made in accordance with this invention have excellent strength, and have structural stability significantly greater than that of the prior art porous cores. The presence of the hollow ceramic particles in the core of this invention significantly enhances the leachability of the core from the interior of metal castings.

The foregoing and other objects, features and advantages of the present invention will become more apparent from the following description of preferred embodiments and accompanying drawings.

BRIEF DESCRIPTION OF DRAWINGS

in FIG. 1(*a*), the core contained no hollow ceramic particles; in FIGS. 1(*b*), 1(*c*) and 1(*d*), the core contained successively greater amounts of hollow ceramic particles.

BEST MODE FOR CARRYING OUT THE INVENTION

Figure 1:
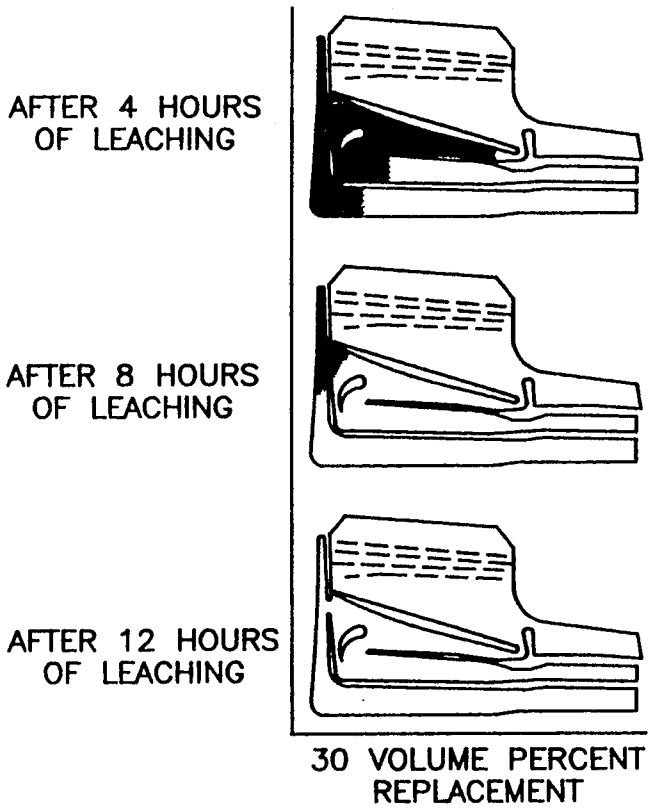
FIG. 1 is a schematic representation showing the amount of core remaining in the interior of a hollow gas turbine engine blade after successive four hour leaching treatments.
Figure 1:
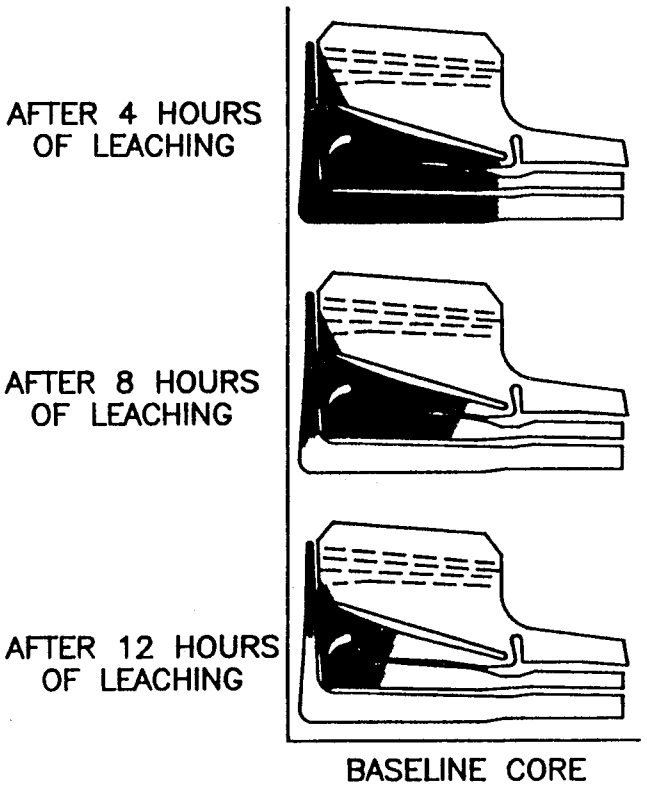
Figure 1:
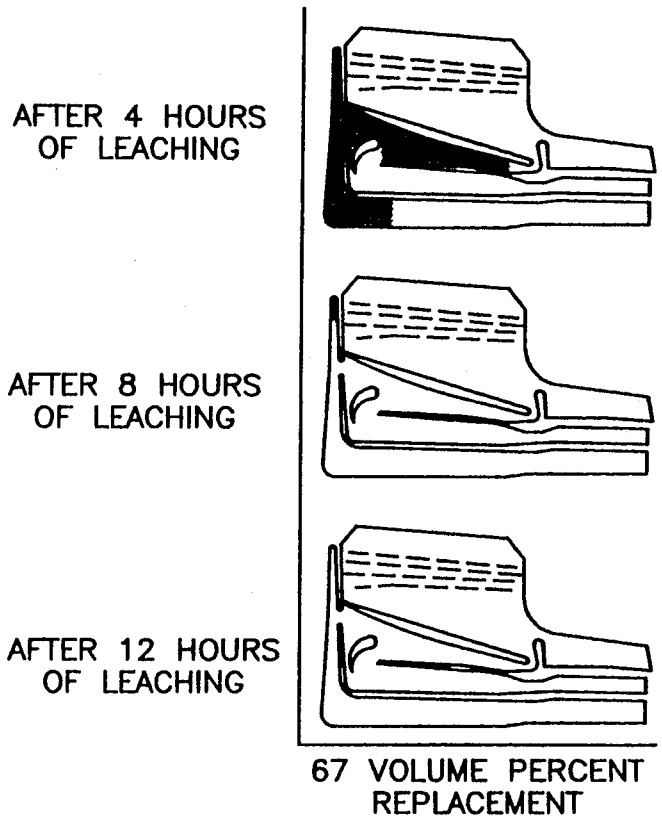
Figure 1:
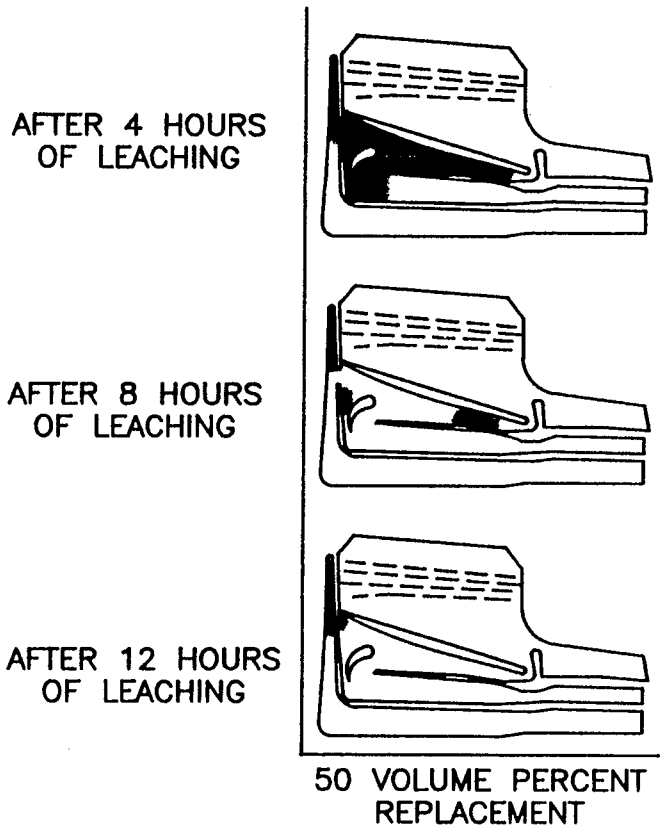

Generally speaking, the cores of this invention are made by mixing ceramic particles together to form a core mixture, molding the mixture to form a core shape, and then firing the core shape to cause the ceramic particles to sinter together to form the finished core. Typical ceramic particles for making cores include silica, alumina and zircon. A binder should be present in the mixture, in an amount sufficient to facilitate the molding process and to give the shape some green strength. During the firing process, the binder is volatilized and the ceramic particles sinter together to form a core which consists essentially of ceramic.

In core mixtures prepared in accordance with this invention, at least one of the solid constituents is soluble in an alkali leaching solution; preferably, the soluble constituent is the ceramic which comprises the majority of the core, i.e., the soluble constituent is the ceramic upon which the core is based.

According to this invention solid constituents in the core are replaced with hollow constituents. The hollow constituents are particles, and they are chosen so that the sintered core has an optimum combination of strength and leachability. Two important considerations with respect to the selection and use of the hollow particles are (1) the physical and chemical characteristics of the hollow particles and (2) the amount that the hollow particles are included in the core.

The hollow particles should have sufficient strength and temperature stability to withstand the molding and firing processes, as well as solidification of the molten metal cast into the mold, without excessive breakage, warpage or other dimensional changes. If the particles are neither strong enough nor sufficiently stable during molding, firing or solidification, then distortion of the core during such processes will likely occur, and castings produced using cores made with hollow particles will not have the desired dimensional characteristics. The best results are achieved when the particles have a diameter within the range of about 15–100 microns (about 0.6–4 mils) and a wall thickness within the range of about 1–10 microns (0.04–0.4 mils). The size of the hollow particles should be approximately the same as the size of the predominant solid particles in the core, in order to achieve an acceptably smooth surface on the core. Furthermore, it is preferred that the particles are leachable in alkali solution, and have a composition which is the same as, or be similar to, the composition of the solid particles which make up the majority of the core.

Even if the hollow particles have the requisite physical and chemical properties, the properties of the core made with such particles will not be adequate unless the proper amount of hollow particles are present. Tests have shown that best results are achieved when hollow particles are present in the core in an amount which is, on a volume percent basis, between about 30 and 70 percent of the total amount of leachable ceramic in the core. In such amounts, the strength of the core is not significantly altered, as confirmed by four point bend tests of cores made with varying amounts of hollow particles. In these tests, the force required to rupture a sintered core comprising, on a weight percent basis, 30 percent solid zircon and 70 percent solid silica is considered the baseline core strength. When the baseline core is modified so that about one third of the solid silica, by volume, is replaced by an equal volume of the aforementioned hollow silica particles, the strength of the modified core is about 67% of the baseline core strength; when the baseline core is modified so that about one half of the solid silica, by volume, is replaced by an equal volume of hollow silica particles, the strength of the modified core is about 84% of the baseline core strength; and when the baseline core is modified to replace about two thirds of the solid silica by volume with an equal volume of hollow silica particles, the strength of the modified core is about 88% of the baseline core strength. If all of the solid silica in the baseline core is replaced by hollow silica particles, the core is not useful: Severe shrinkage during firing is observed, and the core experiences distortion during the metal casting and solidification process.

The invention may be better understood by reference to the following examples, which are intended to illustrate the features of the invention. The examples should not be construed as a limitation on the scope of the invention.

EXAMPLE I

Ceramic cores representative of the type used to make hollow blades for aircraft gas turbine engines are made. The cores have a composition of, on a weight percent basis, 30% solid zircon and 70% solid silica. Tests are conducted to evaluate the effect on leachability of incorporating hollow ceramic particles in the core. The hollow particles are silica, and are obtained from Emerson & Cuming, Dewey & Almy Chemical of Canton, Mass.; then are marketed under the trade name FTF-15 silica microballoons. Hollow silica particles are substituted for the solid silica particles in amounts ranging from 0–67% on a volume basis. The hollow silica microballoons are about −200 mesh, and have diameter ranging between about 2 and 44 microns (between about 0.08 and 1.8 mils) and have a nominal wall thickness of about 2 microns (about 0.8 mils). The solid silica, hollow silica, and solid zircon particles are mixed together in a conventional fashion, injection molded into a core shape using conventional injection molding techniques and then fired to sinter the particles together. Wax patterns are then made using the cores, and shell molds formed around the wax patterns in the conventional fashion. The wax is burned out in a conventional fashion, and then molten metal is poured into the mold cavity where it solidifies. The metal has a nickel base superalloy composition. The mold is broken away and the metal casting, with the core still intact, is immersed in a conventional autoclave containing a leaching solution of about 27.5 weight percent aqueous sodium hydroxide. The temperature within the autoclave is about 190° C. (about 375° F.) and the pressure of about 1.1 MPa (about 155 psi); the solution is agitated by shafted propellers in the autoclave while the autoclave rotates at about 200 rpms for about 145 minutes.

The extent to which the cores are leached from their respective castings, after each of three consecutive 145 minute leaching cycles, is ascertained using x-ray radiography. The results of such measurements are schematically shown in FIG. 1.

Figure 2:
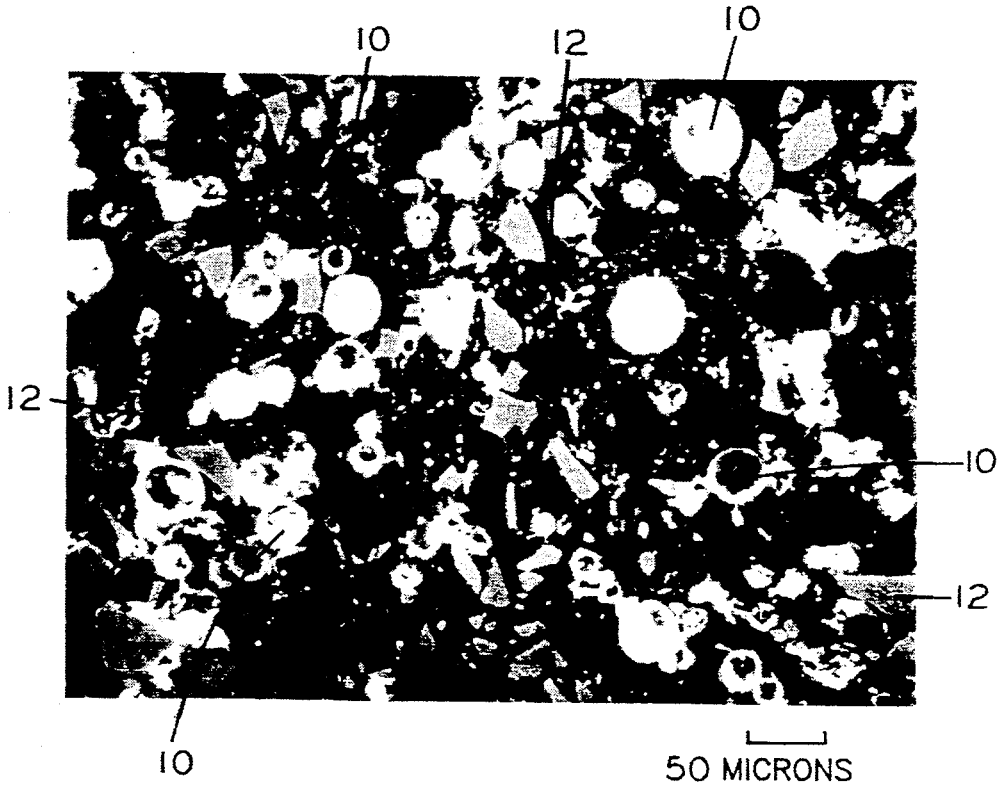
FIG. 2 is a photomicrograph of a core made in accordance with this invention.

FIG. 1 shows the average results of leaching three cores having, in the case of FIG. 1(*a*), no hollow silica particles; in the case of FIG. 1(*b*), an amount of hollow silica particles which corresponds to 30 volume percent of the amount of solid silica particles in the cores of FIG. 1(*a*); in the case of FIG. 1(*c*), an amount of hollow silica particles which corresponds to 50 volume percent of the amount of solid silica particles in the cores of FIG. 1(*a*); and in the case of FIG. 1(*d*), an amount of silica particles which corresponds to 67 volume percent of the amount of solid silica particles in cores of FIG. 1(*a*). The dark areas in the schematics show core which was not removed by leaching. As is seen in comparing FIGS. 1(*b*), 1(*c*) and 1(*d*) with FIG. 1(*a*), dramatic improvements in core leachability are achieved when hollow ceramic particles are present in the core. FIG. 2 shows a photomicrograph of a core made according to the invention. The core consists of hollow particles 10 within a matrix of solid particles 12.

One reason why the invention cores are more leachable than conventional cores (i.e., why the time to remove the invention cores from castings is less than the time to remove conventional cores) is because there is less solid ceramic in the invention cores than in the conventional cores. The hollow particles which are present in the invention cores are less dense than the solid particles they replace; accordingly, there is less ceramic to remove during the leaching process. The hollow ceramic particles consume the hydroxyl ion in the leachant at a rate which is less than the rate that solid particles consume the hydroxyl ions. Leaching time is reduced in approximate proportion to the reduction in core weight achieved by substituting hollow particles for solid particles. Furthermore, the hollow particles increase the amount of surface area available for the leaching reaction to take place, which increases the efficiency of the leaching process.

Leaching occurs primarily at the leachant/core interface, and the movement of the interface during the leaching process is influenced principally by the amount of the soluble constituent (in this example, silica) in the core. The necessity for repeated leachings to remove all of the core is most likely due to the relatively slow process by which reaction products produced during leaching are able to move out of the casting interior. Overall leaching time is reduced by rinsing the casting interior with fresh water after each leaching cycle to allow fresh leachant to reach the core during subsequent cycles. The use of water jets to break up the core, as well as agitating the core in the leaching solution are also effective.

EXAMPLE II

Leaching tests similar to those described in Example I, above, are conducted on the 30% zircon-70% silica core and on modifications to this core. X-ray radiography indicate that at least five leaching cycles at seven hours per cycle are required to entirely remove the core from the interior of an advanced design turbine blade. When the 30 zircon-70 silica core is modified to replace, with hollow silica particles, an amount of solid silica corresponding to about 47 volume percent of silica, the leaching time to entirely remove the core is reduced to three leaching cycles.

EXAMPLE III

Leaching tests similar to those described in Example I, above, are conducted on the ceramic core composition described in the aforementioned patent to Roth, the contents of which are incorporated herein by reference.

Broadly speaking, the Roth core contains, on a weight percent basis, 0–35 zircon or alumina, 1.5–6.5 high temperature stable fibers, balance silica. The high temperature stable fibers are distributed uniformly through the core, and improve the resistance of the core to microcracking. Preferably, the Roth core contains 10–35 zircon, 2–5 alumina fiber, balance silica, where 2–4% of the silica is fumed silica, and the balance is fused silica. The most preferred Roth core contains 28 zircon, 4 alumina fiber, 4 fumed silica, balance fused silica; the alumina fiber has a length to diameter ratio of between 250 and 2,500.

Modified core formulations are prepared in the manner described above, by substituting 30 to 70 percent, by volume, of hollow ceramic particles for the solid fused silica. The formulation is mixed, molded and fired in a conventional manner. A shell mold is then fabricated using the fiber reinforced core containing hollow particles, in the manner described in Example I.

The leachability of the Roth core is improved by substitution of silica microballoons for the solid silica. The benefits, in terms of leachability, are similar to those described in Example I. The strength of the modified Roth core is acceptable.

Although this invention has been shown and described with respect to detailed embodiments thereof, it will be understood by those skilled in the art that various changes in form and detail thereof may be made without departing from the spirit and scope of the claimed invention.

We claim:

1. In a process for making a ceramic core for use in investment casting, comprising mixing solid ceramic particles to form a core mixture, molding the mixture to form a core shape, and heating the core shape to sinter the particles and make a core, the improvement which comprises substituting hollow ceramic particles for between 30 and 70 percent, by volume, of the solid ceramic particles, wherein the core is characterized by solid ceramic particles sintered to each other and to the hollow ceramic particles.

2. The method of claim 1, wherein the hollow particles in the core are unbroken after the molding and heating steps.

3. The method of claim 1, wherein the composition of the hollow particles in the core is the same as the composition of the solid particles in the core.

4. The method of claim 1, wherein the core contains at least two different compositions of hollow particles.

5. The method of claim 4, wherein the core contains high temperature stable fibers which are distributed uniformly through the fired core.

6. In a method for making a casting core containing about 1.5 to about 6.5 weight percent high temperature stable fibers within a sintered ceramic matrix by firing a mixture containing said fibers and solid ceramic particles, the improvement which comprises substituting hollow ceramic particles for a portion of said solid ceramic particles.

7. The method of claim 6, comprising substituting about 30–70 percent by volume of the hollow ceramic particles for the solid ceramic particles.

8. A ceramic shell mold comprising a sintered ceramic core within the mold, said mold and sintered core defining a mold cavity for receiving molten metal, wherein the core comprises about 1.5–6.5 weight percent high temperature stable fibers within a matrix of sintered solid and hollow ceramic particles.

* * * * *